US009266357B1

(12) United States Patent
Facchini, II et al.

(10) Patent No.: US 9,266,357 B1
(45) Date of Patent: Feb. 23, 2016

(54) SYSTEM AND METHOD FOR TREATING A SURFACE OF MEDIA WITH A PLURALITY OF MICRO-HEATERS TO REDUCE CURLING OF THE MEDIA

(71) Applicant: Xerox Corporation, Norwalk, CT (US)

(72) Inventors: Charles T. Facchini, II, Webster, NY (US); David R. Kamprath, Rochester, NY (US); Eliud Robles Flores, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/574,601

(22) Filed: Dec. 18, 2014

(51) Int. Cl.

| | |
|---|---|
| ***B41J 2/01*** | (2006.01) |
| ***B41J 11/00*** | (2006.01) |
| *G03G 15/00* | (2006.01) |
| *B65H 5/36* | (2006.01) |
| *B65H 29/32* | (2006.01) |

(52) U.S. Cl.
CPC ..... *B41J 11/0005* (2013.01); *B41J 11/0045* (2013.01); *B65H 5/36* (2013.01); *B65H 29/32* (2013.01); *G03G 15/6576* (2013.01)

(58) Field of Classification Search
None
See application file for complete search history.

(56) References Cited

U.S. PATENT DOCUMENTS

| | | | | |
|---|---|---|---|---|
| 5,724,628 | A * | 3/1998 | Sano | G03G 15/2064 219/216 |
| 2001/0000020 | A1 | 3/2001 | Roy et al. | |
| 2009/0147039 | A1 | 6/2009 | Koase | |
| 2013/0300797 | A1 | 11/2013 | Azami et al. | |

* cited by examiner

*Primary Examiner* — Lisa M Solomon
(74) *Attorney, Agent, or Firm* — Maginot Moore & Beck LLP

(57) ABSTRACT

An inkjet printer includes a thermally conductive endless belt configured to carry media past at least one printhead with a plurality of inkjets that are configured to eject ink onto a first surface of the media, a plurality of micro-heaters configured to direct heat to a second surface of the media, and a controller. The controller is operatively connected to the at least one printhead and the plurality of micro-heaters, and is configured to operate the inkjets in the at least one printhead to eject ink onto the first surface of the media and to operate the micro-heaters to direct heat into the thermally conductive endless belt to transmit heat to different positions on the second surface of the media selectively.

16 Claims, 2 Drawing Sheets

SYSTEM AND METHOD FOR TREATING A SURFACE OF MEDIA WITH A PLURALITY OF MICRO-HEATERS TO REDUCE CURLING OF THE MEDIA

TECHNICAL FIELD

This disclosure relates generally to inkjet printers, and, in particular, to media treatment in inkjet printers.

BACKGROUND

In general, inkjet printing machines or printers include at least one printhead that ejects drops or jets of liquid ink onto a media surface. An inkjet printer employs inks in which pigments or other colorants are suspended in a carrier or are in solution with a solvent. Once the ink is ejected onto media by a printhead, the carrier is solidified or the solvent is evaporated to stabilize the ink image on the media surface. The ejection of liquid ink directly onto media tends to soak into porous media, such as paper, and change the physical properties of the media. Because the spread of the ink droplets striking the media is a function of the media surface properties and porosity, the absorption of ink can adversely impact print quality.

Media needs to remain flat as it moves through an inkjet printer in order to avoid the ingress of the media surface into the gap between the printhead and the surface supporting the media. Irregularities in the flatness of the media affect image quality since the media may be positioned at angles to the ink drops ejected from a printhead or the media may brush or strike the face of the printhead. Consequently, maintaining the flatness of media, especially in the area opposite the printheads in an inkjet printer, is important. Printer configurations that enable the media to stay flat, therefore, are beneficial.

SUMMARY

In one embodiment, an inkjet printer reduces curl caused by the application of ink to media by directing heat from a plurality of micro-heaters into positions on one side of media being printed. The inkjet printer includes at least one printhead having a plurality of inkjets configured to eject ink, a thermally conductive endless belt operatively connected to an actuator to move the thermally conductive endless belt past the at least one printhead to enable a first surface of media carried by the thermally conductive endless belt to receive ink ejected by the plurality of inkjets in the at least one printhead, a plurality of micro-heaters arranged in an array and configured to direct heat into the thermally conductive endless belt and conduct heat to a second surface of the media that is opposite the first surface of the media, and a controller operatively connected to the at least one printhead, the actuator and the plurality of micro-heaters, the controller being configured to operate the actuator to move the thermally conductive endless belt in a process direction past the at least one printhead, to operate the inkjets in the at least one printhead to eject ink onto the first surface of the media and to operate at least one micro-heater in the plurality of micro-heaters arranged in the array to direct heat from the at least one micro-heater heat into the thermally conductive endless belt and conduct heat to the second surface of the media that is opposite the first surface of the media that receives ink from the at least one printhead contemporaneously with the ejection of ink into the area on the first surface of the media.

A method has been developed for operating an inkjet printer to reduce curl caused by the application of ink to media by directing heat from a plurality of micro-heaters into positions on one side of media being printed. The method includes operating with a controller an actuator to move a thermally conductive endless belt in a process direction past at least one printhead, operating with the controller inkjets in the at least one printhead to eject ink on a first surface of the media being carried by the thermally conductive endless belt, and operating with the controller at least one micro-heater in a plurality of micro-heaters arranged in an array, which is positioned opposite the at least one printhead and on one side of the thermally conductive endless belt, to enable the micro-heaters in the array to direct heat towards the one side of the thermally conductive endless belt and conduct the heat to a second surface of the media that is adjacent the thermally conductive endless belt and opposite the first surface of the media as the at least one printhead ejects ink onto the first surface of the media, heat from the at least one micro-heater is directed to an area on the second surface that is opposite an area on the first surface of the media that receives ink from the at least one printhead contemporaneously with the ejection of ink into the area on the first surface of the media.

DETAILED DESCRIPTION

Figure 1:
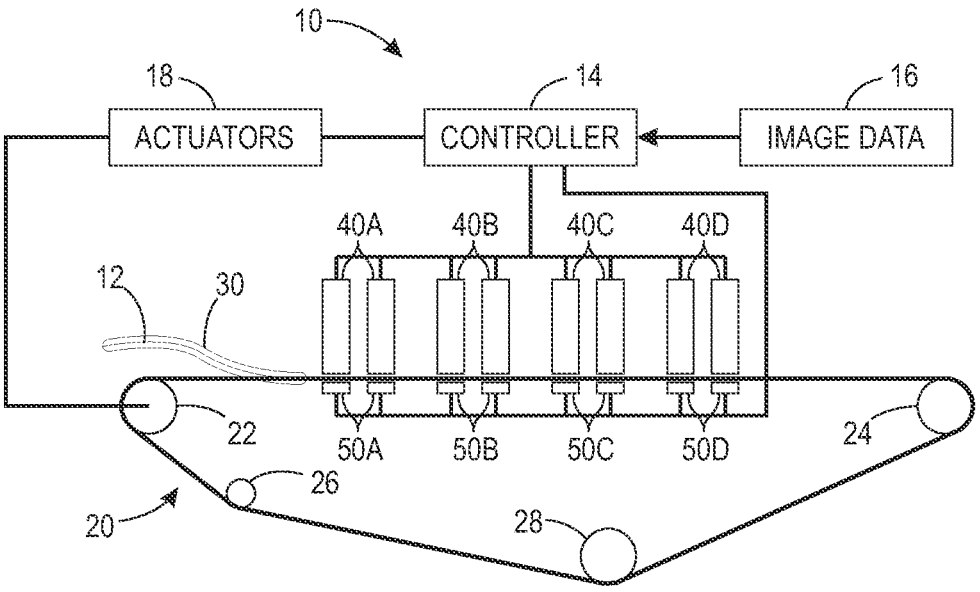
FIG. 1 is a schematic drawing of an inkjet printer that prints sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and/or solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

As used herein, the term "hydrophilic" refers to any composition or compound that attracts water molecules or other solvents used in aqueous ink. As used herein, a reference to a hydrophilic composition refers to a liquid carrier that carries a hydrophilic absorption agent. Examples of liquid carriers include, but are not limited to, a liquid, such as water or alcohol, that carries a dispersion, suspension, or solution of an absorption agent. A dryer then removes at least a portion of the liquid carrier and the remaining solid or gelatinous phase absorption agent has a high surface energy to absorb a portion of the water in aqueous ink drops while enabling the colorants in the aqueous ink drops to spread over the surface of the absorption agent. As used herein, a reference to a dried layer of the absorption agent refers to an arrangement of a hydrophilic compound after all or a substantial portion of the liquid carrier has been removed from the composition through a drying process. As described in more detail below, an indirect inkjet printer forms a layer of a hydrophilic composition on a surface of an image receiving member using a liquid carrier, such as water, to apply a layer of the hydrophilic composition. The liquid carrier is used as a mechanism to convey an absorption agent in the liquid carrier to an image receiving surface to form a uniform layer of the hydrophilic composition on the image receiving surface.

FIG. 1 illustrates a high-speed aqueous ink image producing machine or printer 10 with features that reduce or eliminate sheet input curl present in the media due to environmental factors, such as humidity, or media mishandling, and process curl induced by the deposition of ink on a media. As illustrated, the printer 10 is a printer that ejects ink drops directly on a surface of a media 12, and includes an electronic subsystem (ESS) or controller 14, an endless belt 20 with rollers 22, 24, 26, 28, a mechanical decurler 30, a plurality of printhead modules 40A-40D, a plurality of microheater arrays 50A-50D, and actuators 18.

Controller 14 is operatively connected to actuators 18, printhead modules 40A-40D, and microheaters 50A-50D. Controller 14, for example, is a self-contained, dedicated computer having a central processor unit (CPU) with electronic storage, and a display or user interface (UI). Controller 14 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

Controller 14 receives image data from an image data source 16, such as a scanner or application program. The controller 14 renders the image data and generates firing signals that are used to operate inkjet ejectors in the printheads of the modules 40A-40D to eject ink. The controller 14 also generates electrical signals to operate the actuators 18 to drive one or more rollers about which the endless belt 20 is entrained to move the endless belt about the rollers. The controller 14 also generates electrical signals to operate the microheaters in the arrays 50A-50D in a manner described more fully below.

Prior to an image being printed to media 12, media 12 is retrieved from media storage (not shown) and fed through mechanical decurler 30 by belt 20. Mechanical decurler 30 is configured with an S-shaped bend path, as shown in FIG. 1. The S-shaped bend path of mechanical decurler 30 helps attenuate any irregularities the media may have from its loading into the printer or its storage in the printer. The configuration of the decurler 30 is particularly effective to reduce irregularities of the media in the cross process direction of media 12. Sheet irregularities include folds, creases, wrinkles, or any other curl present in the media caused by media mishandling and other environmental factors, such as humidity. Preexisting sheet input curl is especially prevalent when cut-sheet media is used and the sheets are coated on one side only. In one embodiment, the curves in the S-shaped bend are symmetrical and have radii of between 5 to 20 mm (depending on the stiffness of substrate), which are useful to address sheet input curl in the first 3 to 5 inches of the media. The radii is at the lower end for lower weights of media and at the higher end for heavier weights of media.

After passing through mechanical decurler 30, media 12 travels on endless belt 20 between printhead modules 40A-40D and micro-heater arrays 50A-50D so the printheads in the modules can eject ink onto one surface of the media while the micro-heaters in the arrays can apply heat to an opposite side of the media through the endless belt. Although the printer 10 includes four printhead modules 40A-40D, each of which has two arrays of printheads, alternative configurations can include a different number of printhead modules or arrays within a module.

Printer 10 also includes a plurality of microheater arrays 50A-50D, each of which is positioned underneath the endless belt 20 and opposite one of the printhead modules 40A-40D, as shown in FIG. 1. Controller 14 is configured to generate electrical signals to operate the micro-heaters in the arrays 50A-50D to heat the belt 20 so thermal energy flows into the media 12 as the media continues to move past the printhead modules. The micro-heaters are activated as locations on the opposite side of the media where ink drops are present on the upper surface of the media 12 pass by the micro-heaters. These electrical signals are generated with reference to the rendered image data that the controller uses to generate the firing signals for operation of the printheads as explained above. The application of the electrical signals and the activation of the micro-heaters occur at the locations opposite where ink drops are landing on the media side facing the printheads either contemporaneously or shortly after the ink drops land on media 12. As used in this document, "contemporaneously" means a first event, namely, heating, occurs at or shortly after a second event, namely, ink landing on a media surface. Since belt 20 is made of a heat conducting material, the heat directed from microheaters 50A-50D are conducted through the belt 20 to the side of the media 12 adjacent the belt 20. Applying heat with microheaters 50A-50D helps minimize process curl induced by the deposition of ink on a media by locally drying the media relatively contemporaneously with the ink drops contacting the media 12. Thus, the correspondence between the locations on one side of the media adjacent the locations on the endless belt into which the micro-heaters direct heat and the areas on the opposite side of the media where ink coverage is greater than fifty percent are approximately one-to-one. This degree of correspondence is possible because the array of microheaters 50A-50D are capable of providing hot spots with high resolution to enable the controller 14 to conduct heat to the side of the media adjacent the endless belt 20 as a function of the area coverage of ink on the opposite side of the media. The amount of ink can be defined in terms of the mass of the ink deposited in an area, the volume of the ink deposited in an area, the amount of area to be covered by the ink, or any other metric of the ink deposition. The controller 14 can also control the heat dependent on other factors such as the type of media, the type of printing process, the type or water content of the ink used, or any other relevant factor. In one embodiment, controller 14 determines the amount of ink based on image data received from source 16.

The ability of the micro-heaters to heat media locations to a temperature that evaporates water in media, namely, 100° C., is very dependent upon the thermal conductivity of the endless belt 20. When a highly thermally conductive material, such as aluminum, is used for endless belt 20, modeling has shown that the firing of a micro-heater imparts sufficient thermal energy into the location on the belt adjacent the micro-heater that the media adjacent that location on the belt reaches a temperature that evaporates water in ink on that location approximately 8.37 inches later when the belt is moving at a speed of 847 millimeters per second. When a material, such as conductive rubber or plastic, is used for the endless belt, the temperature does not reach the water evaporation temperature until the media location has moved 8.37 inches past the inkjet location. The total printhead length is approximately 18 inches so the water evaporates before the area passes the printhead. In other words, water from the ink is not absorbed by the media and curling is reduced. Thus, in order to keep curl arising from the presence of water to tolerable levels in the printing area of a printer, a good thermally conductive material needs to be used for the endless belt. Such a material has a thermal conductivity of 118 BTU/hour ° F. ft at 68° F. or greater. As used in this document, "thermally conductive" means a material having a thermal conductivity that is 118 BTU/hour ° F. ft at 68° F. or greater.

Figure 2:
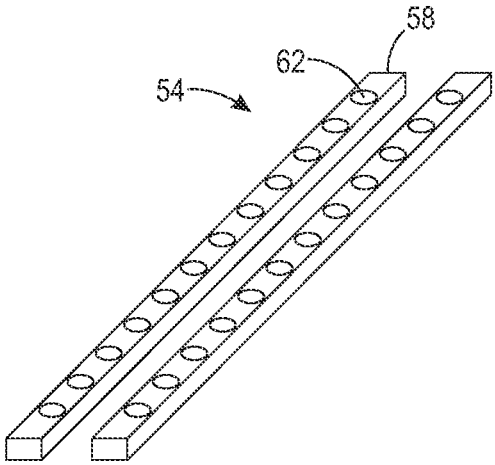
FIG. 2 is a schematic drawing of an array of micro-heaters used in the inkjet printer of FIG. 1.

Microheater arrays 50A-50D can be made of micro-heater pads, or any other known micro-heater. As used in this document, the term "micro-heater" means a heating element made of metal or GAXP material configured in a spiral pattern and which transitions from a non-brittle state to a metal-ceramic state that tends to be brittle when coupled to an electrical current and generates a temperature in the 1400 to 1900 degree range at 500 to 1500 watts. The heating element is typically arranged on a ceramic substrate that is about one inch to about two inches in diameter. One such micro-heater is shown in FIG. 2. The micro-heater pad 54 includes a substrate 58 and a plurality of microheating elements 62 arrayed on the substrate. The substrate can have a thickness in the range of 0.015 μm to 200 μm. One such micro-heater is available from Micropyretics Heaters International of Cincinnati, Ohio and designated by part number MC170. Each heating element is a spirally wound element having an electrical lead at each end that can be independently coupled to an electrical current source. The substrate 58, which can be made of a ceramic as noted above, is at least one inch and can be up to two inches in width and having a length that is slightly longer than a width of a sheet to be printed by the printer in which the micro-heater array is installed. Temperatures in excess of 1000 degrees Celsius, and even up to 1900 degrees Celsius are possible with each micro-heater in the array. Another micro-heater configuration that can be used includes an array of platinum resistance heating elements deposited on a quartz wafer in, for example, a serpentine pattern.

Figure 3:
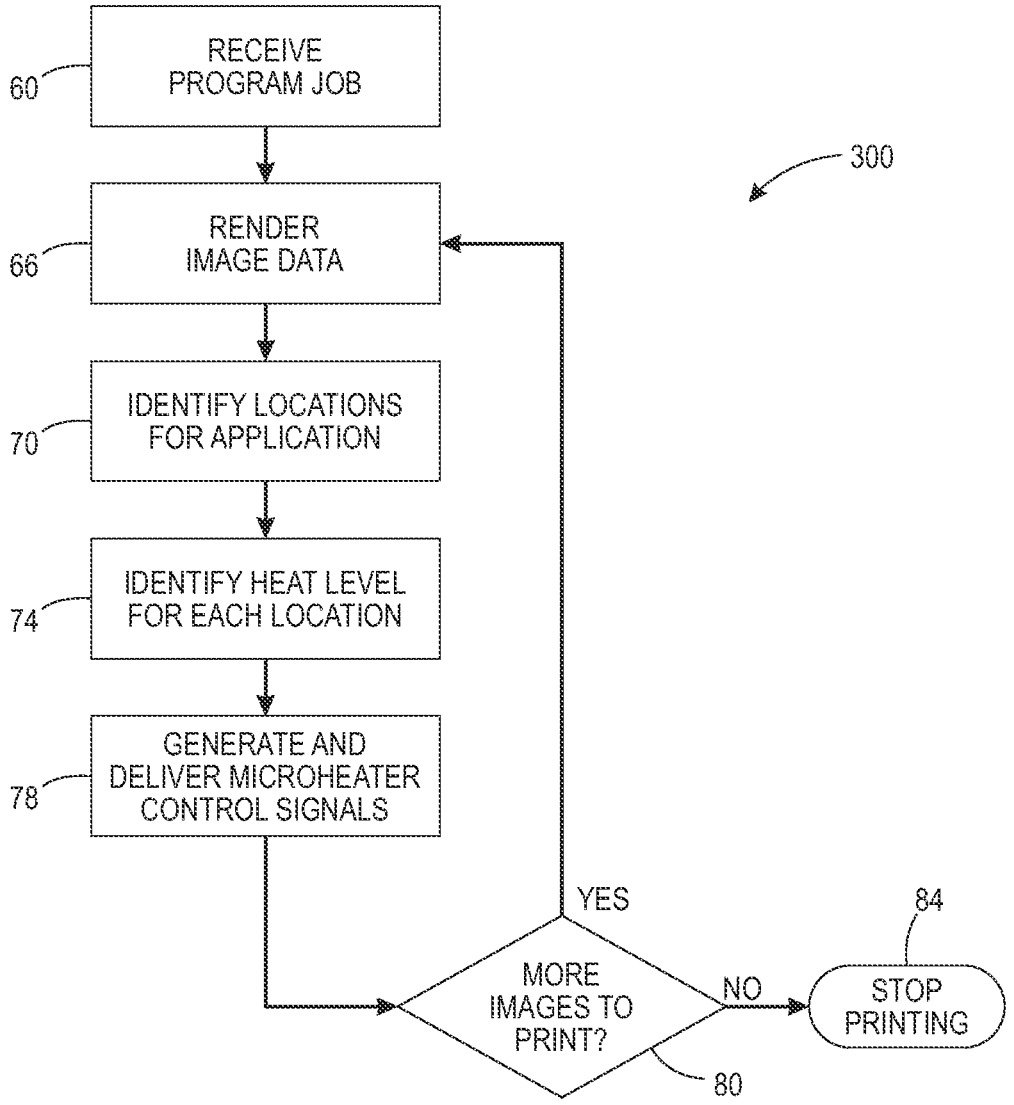
FIG. 3 is a flow diagram of a process for operating the inkjet printer of FIG. 1.

A process for operating a printer having one or more arrays of micro-heaters to reduce media deformation is shown in FIG. 3. In the following description of this process, statements that a process is performing some task or function refers to a controller or general purpose processor executing programmed instructions stored in a memory operatively connected to the controller or processor to manipulate data or to operate one or more components in the printer to perform the task or function. The controller 14 noted above can be such a controller or processor. Alternatively, controller 14 can be implemented with more than one processor and associated circuitry and components, each of which is configured to form one or more tasks or functions described herein.

With continued reference to FIG. 3, upon receipt of a printing job (block 60), process 300 receives data of image content to be printed. These data are rendered to enable the process to generate the firing signals for the printheads (block 66). With reference to these data, the process maps the ink pixels to be printed into a grid of one inch or two inch areas, depending on the diameter of the micro-heater elements, to identify the areas on the sheet where an ink coverage or ink mass threshold is exceeded and curl is possible. The process then identifies the micro-heaters in an array on the opposite side of the media 12 that correspond to these areas and where heat is to be applied by one of the micro-heaters in the arrays 50A-50D (block 70). The process also identifies a heat level for each location with reference to an amount of ink to be ejected onto the side of the media facing the printheads (block 74). The signals for operating the micro-heaters in the arrays 50A-50D are generated and delivered to electrical current control devices, such as FETs, to enable current to flow to the micro-heaters corresponding to the areas where the ink coverage or mass could cause curl as the inkjet ejectors in the printheads of modules 40A-40D are operated to print those areas and form an ink image on the media (block 78). After printing the image, the process determines whether more image data is to be printed (block 80). If more image data is to be printed, the process continues with the processing of block 64. Otherwise, the printing operation ends (block 84).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for reducing curling of a media comprising:

operating with a controller an actuator to move a thermally conductive endless belt in a process direction past at least one printhead;

operating with the controller inkjets in the at least one printhead to eject ink on a first surface of the media being carried by the thermally conductive endless belt; and operating with the controller at least one micro-heater in a plurality of micro-heaters arranged in an array, which is positioned opposite the at least one printhead and on one side of the thermally conductive endless belt, to enable the micro-heaters in the array to direct heat towards the one side of the thermally conductive endless belt and conduct the heat to a second surface of the media that is adjacent the thermally conductive endless belt and opposite the first surface of the media as the at least one printhead ejects ink onto the first surface of the media, heat from the at least one micro-heater is directed to an area on the second surface that is opposite an area on the first surface of the media that receives ink from the at least one printhead contemporaneously with the ejection of ink into the area on the first surface of the media.

2. The method of claim 1, the operation of the least one micro-heater with the controller further comprising:

operating with the controller a first group of micro-heaters in the plurality of micro-heaters to direct heat at a first level to a first plurality of areas on the thermally conductive endless belt to enable the heat to be transmitted to a first plurality of areas on the second surface of the media that are opposite a first plurality of areas on the first surface that receive ink from the at least one printhead, the first group of micro-heaters being operated contemporaneously with the ejection of ink into the first plurality of areas on the first surface; and operating with the controller a second group of micro-heaters in the plurality of micro-heaters to direct heat at a second level to a second plurality of areas on the thermally conductive endless belt to enable the heat to be transmitted to a second plurality of areas on the second surface of the media that are opposite a second plurality of areas on the first surface that receive ink from the at least one printhead, the first level of heat being greater than the second level of heat and the second group of micro-heaters being operated contemporaneously with the ejection of ink into the second plurality of areas on the first surface.

3. The method of claim 2 further comprising:

operating the first group of micro-heaters with the controller to direct heat at the first level to the first plurality of areas on the thermally conductive endless belt to enable the heat to be transmitted to the first plurality of areas on the second surface of the media that are opposite the first plurality of areas on the first surface of the media having a first ink coverage; and operating the second group of micro-heaters with the controller to direct heat at the second level to the second plurality of areas on the thermally conductive endless belt to enable the heat to be transmitted to the second plurality of areas on the second surface of the media that are opposite the second plurality of areas on the first surface of the media having a second ink coverage, the first ink coverage being greater than the second ink coverage.

4. The method of claim 1 further comprising:

operating the micro-heaters in the plurality of micro-heaters with the controller with reference to image data used to operate the inkjets in the at least one printhead.

5. The method of claim 1 further comprising:

moving the media through a decurling mechanism prior to the controller operating the inkjets to eject ink onto the first surface of the media.

6. The method of claim 5 wherein the decurling mechanism includes an S-bend path.

7. The method of claim 1 wherein the plurality of micro-heaters corresponds to an arrangement of the inkjets in the at least one printhead.

8. The method of claim 2 further comprising:

operating with the controller the first group of micro-heaters and the second group of micro-heaters with reference to at least one of: (i) an area of media to be covered by ink; (ii) a volume of ink to be ejected onto the area of media; and (iii) a mass of ink to be ejected onto the area of media.

9. A printer comprising:

at least one printhead having a plurality of inkjets configured to eject ink;

a thermally conductive endless belt operatively connected to an actuator to move the thermally conductive endless belt past the at least one printhead to enable a first surface of media carried by the thermally conductive endless belt to receive ink ejected by the plurality of inkjets in the at least one printhead;

a plurality of micro-heaters arranged in an array and configured to direct heat into the thermally conductive endless belt and conduct heat to a second surface of the media that is opposite the first surface of the media; and a controller operatively connected to the at least one printhead, the actuator and the plurality of micro-heaters, the controller being configured to operate the actuator to move the thermally conductive endless belt in a process direction past the at least one printhead, to operate the inkjets in the at least one printhead to eject ink onto the first surface of the media and to operate at least one micro-heater in the plurality of micro-heaters arranged in the array to direct heat from the at least one micro-heater heat into the thermally conductive endless belt and conduct heat to the second surface of the media that is opposite the first surface of the media that receives ink from the at least one printhead contemporaneously with the ejection of ink into the area on the first surface of the media.

10. The printer of claim 9, the controller being further configured to:

operate a first group of micro-heaters in the plurality of micro-heaters to direct heat at a first level into the thermally conductive endless belt to enable heat to be transmitted to a first plurality of areas on the second surface of the media that are opposite a first plurality of areas on the first surface that receive ink from the at least one printhead, the first group of micro-heaters being operated contemporaneously with the ejection of ink into the first plurality of areas on the first surface; and operate a second group of micro-heaters in the plurality of micro-heaters to direct heat at a second level into the thermally conductive endless belt to enable heat to be transmitted to a second plurality of areas on the second surface of the media that are opposite a second plurality of areas on the first surface that receive ink from the at least one printhead, the first level of heat being greater than the second level of heat and the second group of micro-heaters being operated contemporaneously with the ejection of ink into the second plurality of areas on the first surface.

11. The printer of claim 10, the controller being further configured to:

operate the first group of micro-heaters to direct heat at the first level into the thermally conductive endless belt to enable heat to be transmitted to the first plurality of areas on the second surface of the media that are opposite the first plurality of areas on the first surface of the media having a first ink coverage; and operate the second group of micro-heaters to direct heat at the second level into the thermally conductive endless belt to enable heat to be transmitted to the plurality of second areas on the second surface of the media that are opposite the second plurality of areas on the first surface of the media having a second ink coverage, the first ink coverage being greater than the second ink coverage.

12. The printer of claim 9, the controller being further configured to:

operate the micro-heaters in the plurality of micro-heaters with reference to image data used to operate the inkjets in the at least one printhead.

13. The printer of claim 9 further comprising:

a media transport to move the media through the printer;

a decurling mechanism configured to bend media; and the controller being operatively connected to the media transport, the controller being further configured to operate the media transport to move the media through the decurling mechanism prior to the media being carried by the thermally conductive endless belt.

14. The printer of claim 13, the decurling mechanism further comprising:

an S-bend channel through the decurling mechanism.

15. The printer of claim 9 wherein the plurality of micro-heaters are configured in an array that corresponds to an array of the inkjets in the at least one printhead.

16. The printer of claim 10, the controller being further configured to:

operate the first group of micro-heaters and the second group of micro-heaters with reference to at least one of: (i) an area of media to be covered by ink; (ii) a volume of ink to be ejected; and (iii) a mass of the amount of ink.

* * * * *